US005094479A

United States Patent [19]

Shields

[11] Patent Number: 5,094,479

[45] Date of Patent: Mar. 10, 1992

[54] SKI AND POLE CARRYING DEVICE

[75] Inventor: Michael P. Shields, Mammoth Lakes, Calif.

[73] Assignee: Sierus Innovative Accessories, Inc., Salt Lake City, Utah

[21] Appl. No.: 467,266

[22] Filed: Jan. 18, 1990

[51] Int. Cl.[5] ..... A63C 11/02

[52] U.S. Cl. ..... 280/814; 224/917; 280/809; 280/815

[58] Field of Search ..... 280/814, 815, 809; 224/917; 294/147; 211/70.5

[56] References Cited

U.S. PATENT DOCUMENTS

| | | | |
|---|---|---|---|
| 3,114,487 | 12/1963 | Miller et al. | 224/45 |
| 3,718,242 | 2/1973 | Larson | 224/45 Q |
| 3,854,640 | 12/1974 | Willmarth | 224/45 S |
| 3,877,623 | 4/1975 | Breault | 224/45 S |
| 4,294,387 | 10/1981 | Wnek | 224/315 |
| 4,364,585 | 12/1982 | Shields | 280/814 |
| 4,377,306 | 3/1983 | Abatecola | 294/147 |
| 4,460,207 | 7/1984 | Gies | 294/147 |
| 4,463,885 | 8/1984 | Ball et al. | 224/250 |
| 4,470,528 | 9/1984 | Dyess | 224/257 |
| 4,494,787 | 1/1985 | Gainey | 294/147 |
| 4,531,661 | 7/1985 | Santy | 224/191 |
| 4,620,722 | 11/1986 | Dunn | 280/814 |
| 4,729,591 | 3/1988 | Scalise | 294/141 |
| 4,786,097 | 11/1988 | Howard | 294/147 |
| 4,833,901 | 5/1989 | Sage et al. | 70/58 |
| 4,842,315 | 6/1989 | Nordmeyer | 294/147 |

FOREIGN PATENT DOCUMENTS

| | | | |
|---|---|---|---|
| 2307807 | 8/1974 | Fed. Rep. of Germany | 294/147 |

*Primary Examiner*—Andres Kashnikow
*Assistant Examiner*—Eric Culbreth
*Attorney, Agent, or Firm*—Lyon & Lyon

[57] ABSTRACT

A compact device for carrying a pair of skis and ski poles including a substantially flat body member, a pair of ski pole carrying members pivotally mounted on the body member adjacent opposite ends thereof such that the carrying members can be selectively disposed in a flat horizontal position adjacent the body member or in an upright position substantially perpendicular to the body member. Each of the carrying members defines a pair of oppositely disposed open ended slots therein for releasably carrying a pair of ski poles upon the carrying members being disposed in an upright position. A ski securement strap is secured to and extends from one side of the body member and a strap locking member is pivotally mounted on the body member so as to be moveable between an unlocked and a locked position. The locking member includes a locking surface thereon for engaging the strap intermediary of the ends thereof upon the strap being disposed about a pair of skis positioned adjacent the underside of said body member and extended through the body member. As the locking member is pivoted from the unlocked to the locked position, the securement strap is drawn upwardly and further tightened about the skis and secured in place about the skis in the locked position. The body member is additionally provided with a shallow longitudinal flange depending from the underside thereof which is adapted to be disposed between portions of the skis secured to the device by the securement strap to prevent any lateral rotation of the carrying device with respect to the skis.

12 Claims, 2 Drawing Sheets

SKI AND POLE CARRYING DEVICE

BACKGROUND OF THE INVENTION

The present invention relates to a compact device for holding together and carrying a pair of snow skis and ski poles. Snow skis and poles are relatively heaving and very unwieldy and accordingly have presented a handling problem when they must be carried over any distance, particularly for women and young children. While a number of devices have heretofore been developed in an attempt to assist the skier in handling his equipment, such as those described in U.S. Pat. Nos. 3,877,623, 4,377,306 and 4,786,097, such devices are too bulky to be conveniently carried on the skier when skiing. As convenient storage facilities are not always readily available, and many skiers do not desire to spend time searching out such facilities, additional ski carrying equipment has met with only limited acceptance. While efforts have been made to make such carrying devices more compact, as seen in U.S. Pat. Nos. 4,494,787 and 4,531,661, those devices either require two separate carrying units, which again is space consuming, or fail to provide the desired tight securement of the skis and poles necessary to effect easy handling of such awkward equipment.

SUMMARY OF THE INVENTION

Briefly, the present invention provides a collapsible ski and pole carrier which, in the collapsed position defines a flat compact configuration easily carried on the skier's person while skiing and, in the extended position securely retains a pair of skis and poles such that they can be readily carried. The carrying device of the present invention includes a generally rectangular flat body member having a shallow longitudinal flange depending from the underside thereof, a pair of ski pole carriers pivotally mounted on the opposite ends of the body member so as to be moveable between a flat disposition adjacent the body member and an upright carrying position, a ski securement strap secured to one side of the body member and a pivotally mounted strap locking member disposed in the body member.

In the compact collapsed mode, the pole carriers are pivoted inwardly adjacent the body member and ski securement strap is wrapped about the flat body member and ski pole carriers and secured against itself by suitably disposed hook and pile fasteners to define a single, relatively flat unit which can be easily carried on one's person while skiing. In the ski carrying mode, the pole carriers are pivoted to an upright position perpendicular to the body member and the strap locking member is pivoted to the open position. The skis are then positioned against the underside of the body member with the longitudinal depending flange being disposed between the upper edges of the parallel skis. The securement strap is then wrapped tightly about the skis and extended between the body member and the open locking member therein whereupon pivoting the locking member to the closed position flush with the body member draws the securement strap even more tightly about the skis and secures the strap to the body member. The free end of the strap is then secured to the strap intermediary of its ends by a hook and pile fastener. The ski poles can then be readily secured to the device by a press-fit within aligned channels formed in the ski pole carriers. So secured, the portions of the ski poles disposed between the upstanding ski carriers form a convenient handle for carrying the aligned skis and poles. If desired, the aligned and secured skis and poles could also be carried on one's shoulder whereupon the ski securement strap would be disposed between the skis and the carrier's sweater or parka, protecting the garment from any moisture and dirt on the skis.

It is the principle object of the present invention to provide a collapsible ski and pole carrier which, in the collapsed mode defines a flat compact configuration easily carried by the skier while skiing, and in the extending mode is adapted to securely retain a pair of skis and poles such that they can be readily carried.

Other objects and advantages of the present invention will become readily apparent from the following detailed description taken in conjunction with the accompanying drawings.

IN THE DRAWINGS

DESCRIPTION OF THE PREFERRED EMBODIMENT

Figure 1:
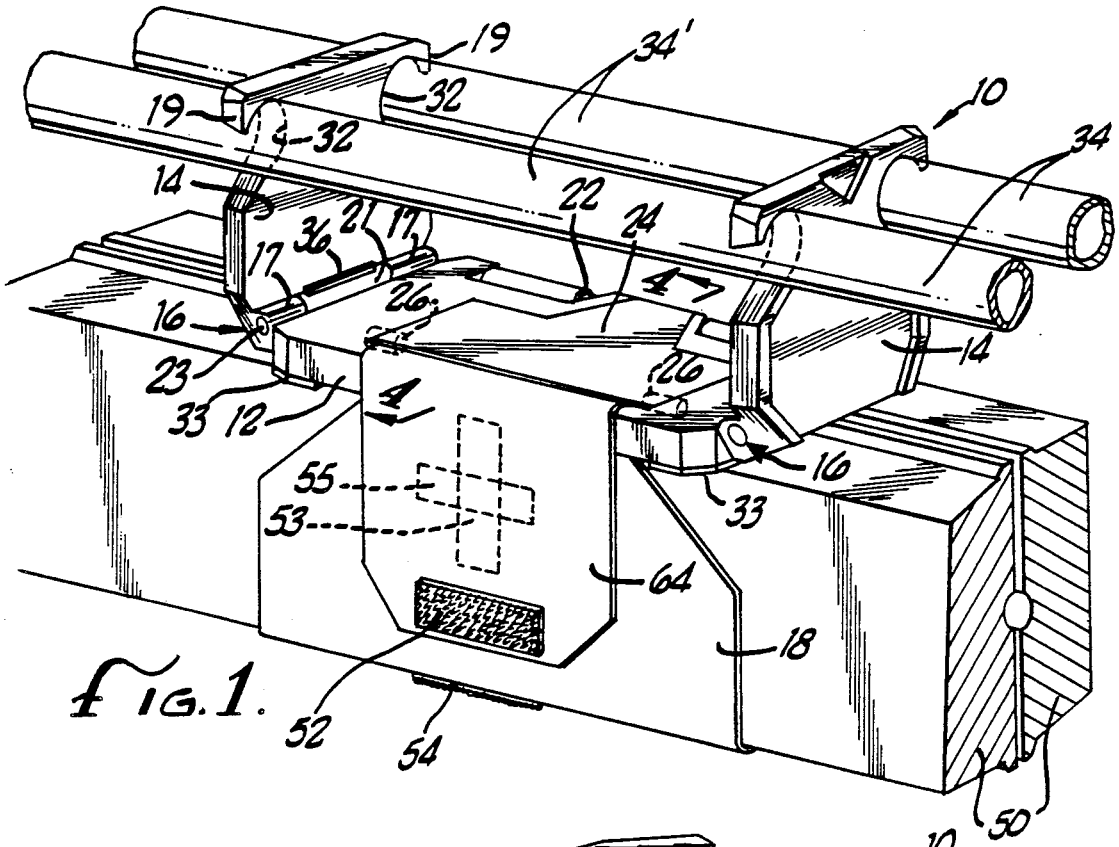
FIG. 1 is a perspective view of the present invention illustrating a pair of the skis and ski poles secured thereto.

Referring now in detail to the drawings, the ski and pole carrying device 10 comprises a generally rectangular flat body member 12, a pair of ski pole carriers 14 pivotally secured to the opposite ends of body member 12 by means of hinges 16, an elongated ski securement strap 18 secured to body member 12 adjacent one side 20 thereof by means of a pair of longitudinal bars 22, and a strap locking member 24 pivotally mounted on the body member 12 on a pair of inwardly projecting studs 26. A centrally disposed longitudinal flange 28 depends from the underside 30 of body member 12. Body member 12 and the pole carriers 14 are preferably constructed of a durable semi-rigid yet flexible high impact material such as ABS plastic.

Figure 2:
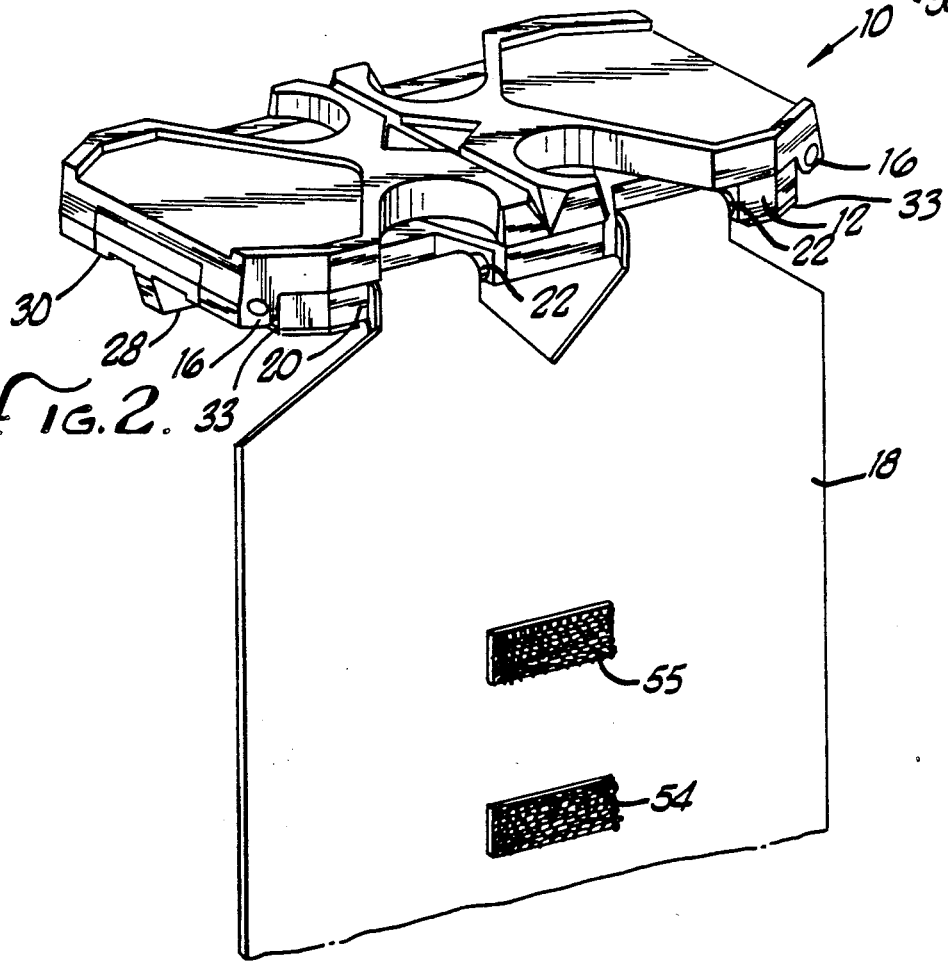
FIG. 2 is a perspective view of the present invention illustrating the pole carriers in the collapsed mode.

The ski pole carriers 14 can be pivoted by means of hinges 16 between a collapsed disposition illustrated in FIG. 2 and an upright position illustrated in FIG. 1. Each of hinges 16 is preferably comprised of a pair of curvilinear members 17 integrally formed with a ski pole carrier 14 inwardly adjacent ear portions 19 thereof, a cooperating curvilinear portion 21 integrally formed with the body member 12 and a pivot pin 23. Pivot pins 23 are preferably held tightly within the portions 17 of hinges 16 so as to be rotatable therewith and with respect to the portions 21 of the hinges formed with body member 12 so as to avoid the ends of pins 23 protruding from the inwardly tapered lower portions of the ski pole carriers 14 upon pivoting carriers 14 on body member 12. Each of the pole carriers 14 define a pair of opposed open ended slots 32 in the opposite sides thereof therein for receiving a pair of ski poles 34 when the carriers 14 are disposed in the upright position as illustrated in FIG. 1. To secure the poles 34 within slots 32, the pole carriers 14 each define a pair of depending shoulders 35 which effectively reduce the transverse dimension of the slots 32 at the open outer ends 32' thereof. Slots 32 and shoulders 35 are sized to accommodate the variations in diameters of standard ski poles. A fixed upstanding tab 36 is provided on each of curvilinear portions 21 of hinges 16 so that when the ski pole carriers 14 are pivoted to the upright position, the tabs 36 will project above the lower edge of the ski pole carriers 14 to semi-lock the ski poles carriers 14 in the upright position.

Figure 4:
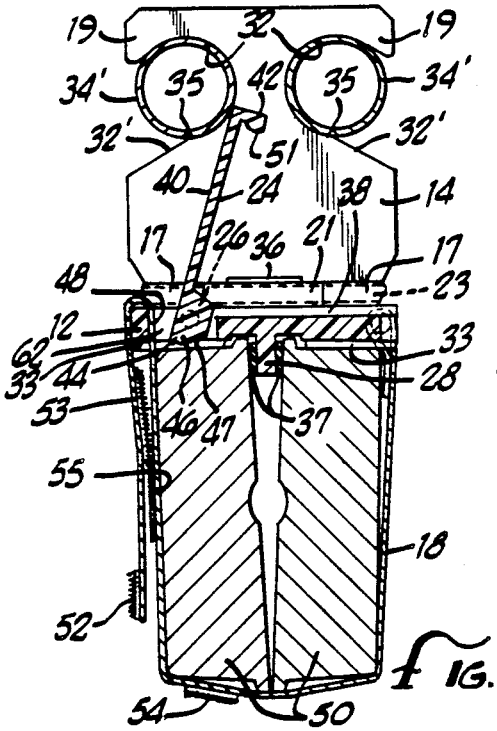
FIG. 4 is a sectional end view illustrating the strap locking member in the open position and taken along line 4—4 of FIG. 1.
Figure 5:
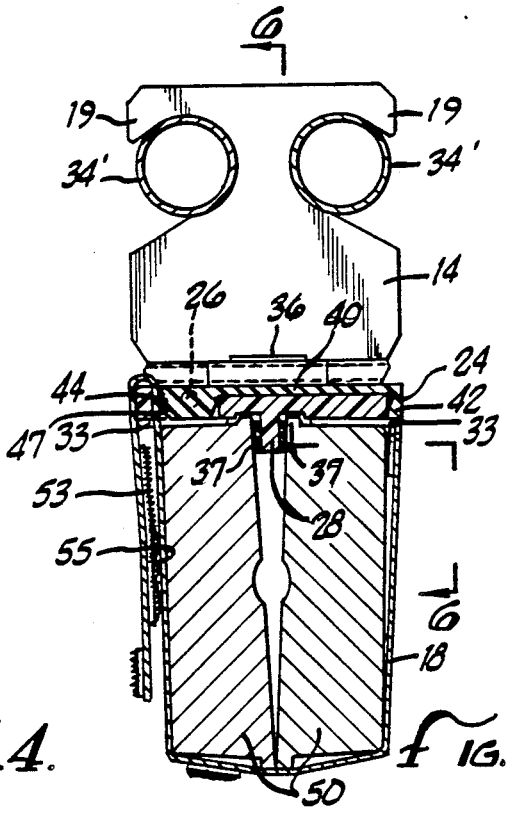
FIG. 5 is a sectional end view illustrating the strap locking member in the locked position.
Figure 6:
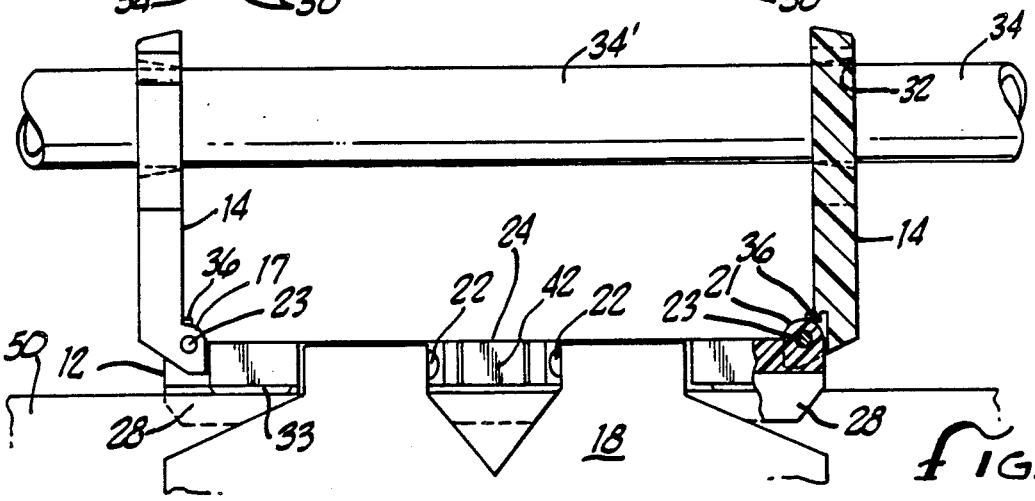
FIG. 6 is a partial sectional view taken along line 6—6 of FIG. 5.

Body member 12 has a opening 38 therein to accommodate the strap locking member 24 such that when the strap locking member 24 is in the locked position, the upper surface thereof is substantially flush with the upper surface of the body member 12. The strap locking member 24 defines a flat body portion 40, a depending end flange 42 to facilitate opening and closing of the locking member 24, and an enlarged base portion 44 which is pivotally secured to the body member 12 on studs 26. The base portion 44 defines a longitudinally disposed curvilinear locking surface 46 preferably having serrations 47 therein which is spaced from an interior side wall 48 of body member 12 such that when the strap locking member 24 is in the raised unlocked position, illustrated in FIG. 4, the ski securement strap 18 can be readily inserted between side wall 48 and locking surface 46. However, when the strap locking member 24 is pivoted on studs 26 to the closed locking position, the curvilinear locking surface 46 is rotated upwardly reducing the spacing between the interior side wall 48 of the body member 12 and locking surface 46 on the base portion 44 of the strap locking member 24 such that when the ski securement strap 18 is disposed therebetween, the curvilinear locking surface 46 will bear against the ski securement strap 18 causing the ski securement strap to be drawn upwardly through the body member 12, thereby effecting a tightening of the ski securement strap 18 about the skis 50 as will be further described. When the strap locking member 24 reaches the flat locked position illustrated in FIG. 5, the ski securement strap is tightly held between wall 46 and surface 46 of the locking member 24. A tab 51 is provided on locking member 24 for engagement with the body member 12 to retain the locking member in the flat locked position.

Figure 3:
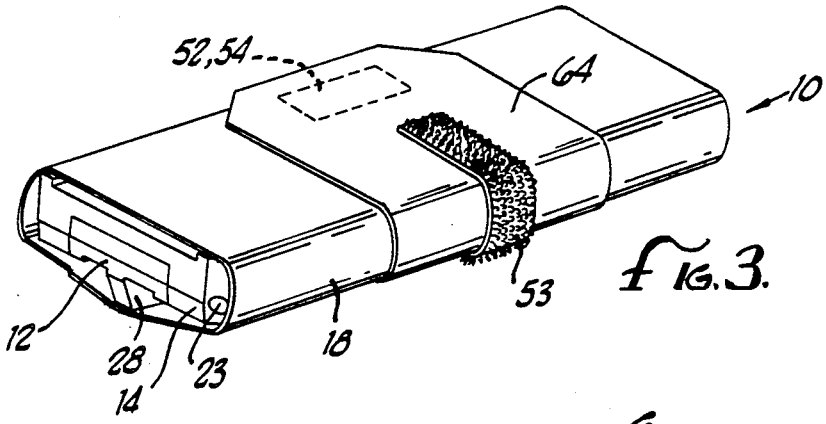
FIG. 3 is a perspective view of the present invention in the collapsed mode.

In the compact collapsed mode, the ski pole carriers 14 are pivoted to the horizontal position adjacent body member 12 illustrated in FIG. 2 and the ski securement strap 18 is wrapped tightly about the body member 12 and adjacent ski pole carriers 14 and secured on itself intermediary of its ends by means of hook and pile fasteners 52 and 54 as illustrated in FIG. 3. For use in the carrying mode, the ski pole carriers 14 are pivoted about hinges 16 to the upright position and the strap locking member 24 is pivoted to the raised unlocked position. A pair of skis 50 are then disposed against the underside 30 of the body member 12 such that the depending flange 28 on the underside of the body member is disposed between the skis to prevent any lateral rotation of the carrying device about the skis. To protect the sharp edges of the skis 50, four rubber foot members 33 are preferably secured by a suitable adhesive to the underside 30 of body member 12 adjacent the four corner thereof and a pair of protective rubber members 37 are secured to the sides of depending flange 28 such that the edges of the skis will abut and be drawn against protective members 33 and 37 as opposed to directly contacting the member 12. The ski securement strap 18 is then wrapped about the skis and inserted through the body member 12 in the space 62 between the interior side wall 48 thereof and of the base portion 44 of the strap locking member. After pulling the ski securement strap 18 tightly about the skis, the ski locking member 2 is rotated to the closed locking position. As the ski locking member is moved to the closed position, the curvilinear locking surface 46 presses the strap tightly against the interior side wall 48 of the base member 12 while drawing the strap slightly upwardly and thereby further tightening the ski securement strap 18 about skis 50. When the strap locking member 24 is snapped into the locked position, the ski securement strap 18 is tightly held about the parallel skis 50, rigidly securing the holding device 10 to the skis. The extended free end 64 of the ski securement strap 18 is then secured back on the strap intermediary of its ends by means of hook and pile fasteners 53 and 55.

Having secured the skis to the carrying device 10, the ski poles 34 can then be readily inserted into slots 32 in the ski pole carriers 14, securing the device 10 to the poles. The portions 34' of the ski poles disposed between the two ski pole carriers 14 then provide a convenient handle for carrying the poles and skis secured by device 10. Additionally, the ski securement strap 18 which preferably defines a width over the majority of its length equal to the length of the body member 12, will protect the skier's parka or sweater from any snow or dirt on the skis should the skier desire the carry the secured skis and poles on his or her shoulder. If desired, a thin layer of soft material could be secured to that portion of the strap disposed below the lower sides of the skis to cushion the weight of the skis and poles on the skier's shoulder without appreciably increasing the thickness of the carrying device 10 in the compact mode.

Various changes and modifications may be made in carrying out the present invention. Insofar as these changes and modifications are within the purview the appended claims, they are to be considered as part of the present invention.

I hereby claim:

1. A device for carrying a pair of skis and ski poles comprising:

a substantially flat rigid body member having a pair oppositely disposed longitudinal ends and transverse ends;

a pair of ski pole carrying members pivotally mounted on said body member adjacent said transverse ends thereof such that said body members can be selectively disposed in a horizontal position adjacent said body member or in an upright position disposed above said body member, each of said carrying members defining a pair of oppositely disposed open ended slots therein for releaseable carrying a pair of ski poles above said body member upon said carrying members being disposed in said upright position;

a ski securement strap having first and second ends, said first end being secured to said body member adjacent one of said longitudinal ends thereof; and a strap locking member mounted on said body member for pivotal movement between an unlocked and locked position and including a locking surface thereon for engaging said strap intermediary of the ends of said strap upon said strap being disposed about a pair of skis positioned adjacent the underside of said body member and extended through said body member, said locking surface bearing against said strap and tightening said strap about said skis as said locking member is pivoted from the unlocked to the locked position and securing said strap about said skis in the locked position.

2. The carrying device of claim 1 including a flange depending from the underside of said body member and adapted to be disposed between portions of the skis secured to said device by said securement strap to prevent rotational lateral movement of said device with respect to said skis.

3. The carrying device of claims 1 or 2 including means for securing said second end of said strap to said strap intermediary of the ends of said strap upon said strap being disposed about said body member and said ski pole carrying members upon said carrying members being disposed in a horizontal position adjacent said body member and upon said strap being disposed about a pair of skis and locked to said body member by said strap locking member.

4. The carrying device of claim 3 wherein said securing means comprises a pair of hook and pile fasteners, a first portion of each pair being secured to one side of said strap proximate said second end thereof and a second portion of each pair being secured to the other side of said strap intermediary of the ends thereof.

5. A device for carrying a pair of skis and ski pools comprising:

a substantially flat rigid body member;

a pair of ski pole carrying members adjustably mounted on said body member such that said members can be selectively disposed in a horizontal position adjacent said body member or in an upright position disposed above said body member, said carrying members having pole securement means thereon for releasably securing thereto a pair of ski poles above said body member, upon said carrying members being disposed in said upright position;

a ski securement strap having first and second ends for securing the skis to said body member, a first end of said strap being secured to said body member;

a strap locking member having a flat body portion, a base portion and a curvilinear locking surface disposed about a portion of said base portion, said locking member being mounted on said body member adjacent said base portion thereof for pivotal movement between a raised unlocked position and a flat locked position, said locking surface engaging said strap intermediary of the ends of said strap upon said strap being disposed about a pair of skis positioned adjacent the underside of said body member and extended between said body member and said base portion of said locking member, and drawing said strap upwardly as said locking member is pivoted between said unlocked to said locked position and securing said strap about the skis and to said body member in the locked position whereby the ski poles upon being secured in said pole securement means define a carrying handle for said device and the skis secured thereto; and means for securing said second end of said strap to said strap intermediary of the ends of said strap upon said strap being disposed about said body member and said ski pole carrying members upon said carrying members being disposed in a horizontal position adjacent said body member and upon said strap being disposed about a pair of skis and locked to said body member by said strap locking member.

6. The carrying device of claim 5, wherein said securing means comprises a pair of hook and pile fasteners, a first portion of each pair being secured to one side of said strap proximate said second end thereof and a second portion of each pair being secured to the other side of said strap intermediary of the ends thereof.

7. A device for carrying a pair of skis and ski poles comprising:

a body member having a first side and a second side;

a pair of ski pole carrying members mounted on said body member such members can be selectively disposed in a first position adjacent said member or in a second position extending outwardly from said first side of said body member;

pole securement means carried by said ski pole carrying members for releasably securing thereto a pair of ski poles in a parallel disposition spaced outwardly from said first side of said body member upon said ski pole carrying members being disposed in said second position;

a ski securement strap connected to said body member, and being operable between a first configuration in which said strap is snugly secured about said body member and a second configuration in which said strap secures a pair of skis to said second side of said body member, said strap defining first and second ends, said first end being secured to said body member, and including means for securing said strap in said first configuration and means for securing said second end of said strap to a portion to said strap intermediary of the ends thereof in said second configuration; and a strap locking means carried by said body member for locking said strap to said body member in said second configuration upon said strap being drawn about a pair of skis disposed adjacent second side of said body member.

8. The carrying device of claim 7 wherein said securing means comprises a pair of hook and pile fasteners, a first portion of each pair being secured to one side of said strap proximate said second end thereof and a second portion of each pair being secured to the other side of said strap intermediary of the ends thereof.

9. A device for carrying a pair of skis and ski poles comprising:

a substantially flat body member;

a pair of ski pole carrying members pivotally mounted on said body member adjacent opposite ends thereof such that said members can be selectively disposed in a horizontal position adjacent said body member or in an upright position substantially perpendicular to said body member, said carrying members having means thereon for releasably securing thereto a pair of ski poles upon said carrying means being disposed in said upright position;

a ski securement strap having first and second ends, the first end thereof being secured to said body member;

a strap locking means carried by said body member for locking said securement strap to said body member intermediary of the ends of said strap upon said strap being drawn about a pair of skis disposed below and adjacent said body member; and means for securing said strap about said body member and said ski pole carrying members upon said carrying members being disposed in a horizontal position adjacent said body member and for securing said second end of said strap to a portion of said strap intermediary of the ends thereof upon said strap being disposed about a pair of skis and locked to said body member by said strap locking means.

10. A device for carrying a pair of skis and ski poles comprising:

a substantially flat body member;

a pair of ski pole carrying members pivotally mounted on said body member adjacent opposite ends thereof such that said members can be selectively disposed in a horizontal position adjacent said body member or in an upright position substantially perpendicular to said body member, said carrying members having means thereon for releasably securing thereto a pair of ski poles upon said carrying means being disposed in said upright position;

a ski securement strap having first and second ends, the first end thereof being secured to said body member;

a strap locking means carried by said body member for locking securement strap to said body member intermediary of the ends of said strap upon said strap being drawn about a pair of skis disposed below and adjacent to said body member; said strap locking means being pivotally mounted on said body member and including a locking surface adapted to engage said strap upon said strap being disposed about the skis and through said body member and tighten said strap about the skis as said strap locking means is pivoted on said member; and means for securing said strap about said body member and said ski pole carrying members upon said carrying members being disposed in a horizontal position adjacent said body member and for securing said second end of said strap to a portion of said strap intermediary of the ends thereof upon said strap being disposed about a pair of skis and locked to said body member by said strap locking means.

11. A device for carrying a pair of skis and ski poles comprising:

a substantially flat body member;

a pair of ski pole carrying members pivotally mounted on said body member adjacent opposite ends thereof such that said members can be selectively disposed in a horizontal position adjacent said body member or in an upright position substantially perpendicular to said body member, said carrying members having means thereon for releasably securing thereto a pair of ski poles upon said carrying members being disposed in said upright position;

a ski securement strap having first and second ends, the first thereof being secured to said body member;

a strap locking member having a flat body portion, a base portion and a curvilinear locking surface disposed about a portion of said base portion, said locking member being mounted on said body member adjacent said base portion thereof for pivotal movement between a raised unlocked position and a flat locked position, said locking surface engaging said strap intermediary of the ends of said strap upon said strap being disposed about a pair of skis positioned adjacent the underside of said body member and extended between said body member and said base portion of said locking member, and drawing said strap upwardly as said locking member is pivoted between said unlocked to said locked position and securing said strap about the skis and to said body member in the locked position; and means for securing said second end of said strap to said strap intermediary of the ends of said strap upon said strap being disposed about said body member and said ski pole carrying members upon said carrying members being disposed in a horizontal position adjacent said body member and upon said strap being disposed about a pair of skis and locked to said body member by said strap locking member.

12. The carrying device of claim 11 including a flange depending underside of said body member and adapted to be disposed between portions of the skis secured to said device by said securement strap to prevent rotational lateral movement of said device with respect to said skis.

* * * * *